US006296042B1

(12) United States Patent
Hung

(10) Patent No.: US 6,296,042 B1
(45) Date of Patent: Oct. 2, 2001

(54) WINDOW CURTAIN TIEBACK DEVICE

(76) Inventor: Kae-Jye Hung, No.610, Shui - Yuan Road, Chang-Hua City (TW)

( * ) Notice: Subject to any disclaimer, the term of this patent is extended or adjusted under 35 U.S.C. 154(b) by 0 days.

(21) Appl. No.: 09/527,827

(22) Filed: Mar. 17, 2000

(51) Int. Cl.[7] ..... A47H 19/00
(52) U.S. Cl. ..... 160/349.2; 248/289.31
(58) Field of Search ..... 160/349.2, 349.1; 24/510, 511; 211/100, 32; 248/289.31

(56) References Cited

U.S. PATENT DOCUMENTS

| | | | |
|---|---|---|---|
| 769,970 | * | 9/1904 | Wertheimer . |
| 2,154,161 | * | 4/1939 | Heckman . |
| 2,191,934 | * | 2/1940 | Epstein . |
| 2,259,166 | * | 10/1941 | Kendrick . |
| 2,597,115 | * | 5/1952 | Lundstrum . |
| 2,701,114 | * | 2/1955 | Donaldson . |
| 4,323,162 | * | 4/1982 | Steinhilber . |

FOREIGN PATENT DOCUMENTS

| | | | | |
|---|---|---|---|---|
| 10045 | * | 7/1884 | (GB) | 160/349.2 |
| 20515 | * | 8/1912 | (GB) | 160/349.2 |
| 27857 | * | 12/1912 | (GB) | 24/510 |

* cited by examiner

*Primary Examiner*—Blair M. Johnson
(74) *Attorney, Agent, or Firm*—Dougherty & Troxell

(57) ABSTRACT

A window curtain tieback device, the structural configuration of which is comprised of a clip mount positioned at the bottom end of a body that provides for the tacking of a window curtain, with the body of the clip mount having a bottom wall surface of a certain thickness and, furthermore, a recess formed in the bottom end. A draw bar is inserted into the recess and, furthermore, after the draw bar has been inserted, a joint section is formed between it and the bottom wall surface of the body. Internally positioned in a hole through the top end of the draw bar is a torsion spring and, furthermore, the top end of the draw bar is hinged via an insertion pin to the vertical surface of a top support member at the side of the body. The hooked section of the top support member is insertionally positioned in the joint section formed between the bottom end of the body and the draw bar. One end of the said top support member ascends vertically and, furthermore, respectively formed in its vertical surface and horizontal surface are threaded fastening holes. The threaded fastening holes in the horizontal surface of the top support member consists of a protruding form such that when mounted to walls, the protruding area not only substitutes as a washer, but also eliminates projecting fasteners when attached to wall surfaces. As such, the invention herein provides a window curtain tieback device that is simple to assemble and, furthermore, attractive in appearance.

4 Claims, 6 Drawing Sheets

WINDOW CURTAIN TIEBACK DEVICE

BACKGROUND OF THE INVENTION

1) Field of the Invention

The invention herein relates to a window curtain tieback device comprised of a draw bar inserted into the bottom end of a body and, furthermore, after the draw bar has been inserted therein, a joint section is formed between it and the bottom wall surface of the body; a torsion spring is positioned in the hinge section at the top end of the said draw bar and, furthermore, the top end of the draw bar is hinged via an insertion pin to a top support member such that one end of the top support member is secured to the side of the body and the other end is positionally inserted into the joint section formed between the bottom end of the body and the draw bar; threaded fastening holes in the horizontal surface of the top support member consist of a protruding form such that when installed to walls, the protruding area not only substitutes as a washer, but also eliminates projecting fasteners when attached to wall surfaces; as such, the invention herein provides a window curtain tieback device that is simple to assemble and, furthermore, attractive in appearance.

2) Description of the Prior Art

At present, window curtains are installed in homes and mass transportation vehicles (such as trains and buses). When sunlight blockage is not required and they are pulled open, the curtains are draped onto hooks at the sides of the windows and tacked in position by small bands. However, this tieback method is actually quite troublesome and, furthermore, the small bands for binding around the hooks are easily lost, leaving no means of tacking the draped window curtains. Resulting situations commonly observed include users securing the window curtains in various random ways or finding an odd length of cord for typing them in place. Regardless of the particular approach, the ends of the window curtains usually end up in unsightly knots.

SUMMARY OF THE INVENTION

The primary objective of the invention herein is to provide a window curtain tieback device comprised of draw bar inserted into the bottom end of a body and, furthermore, after the draw bar has been inserted, a joint section formed between the bottom wall surface of the body and the draw bar; a torsion spring is positioned in the hinge section at the top end of the said draw bar and, furthermore, the top end of the said draw bar is hinged to a top support member; respectively formed in the vertical surface and horizontal surface of the said top support member are threaded fastening holes and, furthermore, the threaded fastening holes in the horizontal surface of the top support member consists of a protruding form and the threaded fastening holes of the vertical surface provides for attachment to the side of the body; the threaded fastening holes protruding from the horizontal surface provide for installation to a wall, with the protruding area not only substituting for a washer, but also eliminates projecting fasteners when the top support member is attached to a wall; as such, the invention herein provides a window curtain tieback device that is simple to assemble and, furthermore, attractive in appearance.

Another objective of the invention herein is to provide a window curtain tieback device that is attractive in appearance and in which the clip mount is directly positioned on the bottom end of the body such that management of the small tacking bands is not required as in case of the conventional versions and enables the clip mount of the present invention to always remain integrated with a three-dimensional floral form to effectively achieve an attractive appearance.

BRIEF DESCRIPTION OF THE DRAWINGS

FIG. 1-A is an isometric drawing of the rear surface of the invention herein.

DETAILED DESCRIPTION OF THE INVENTION

Figure 1:
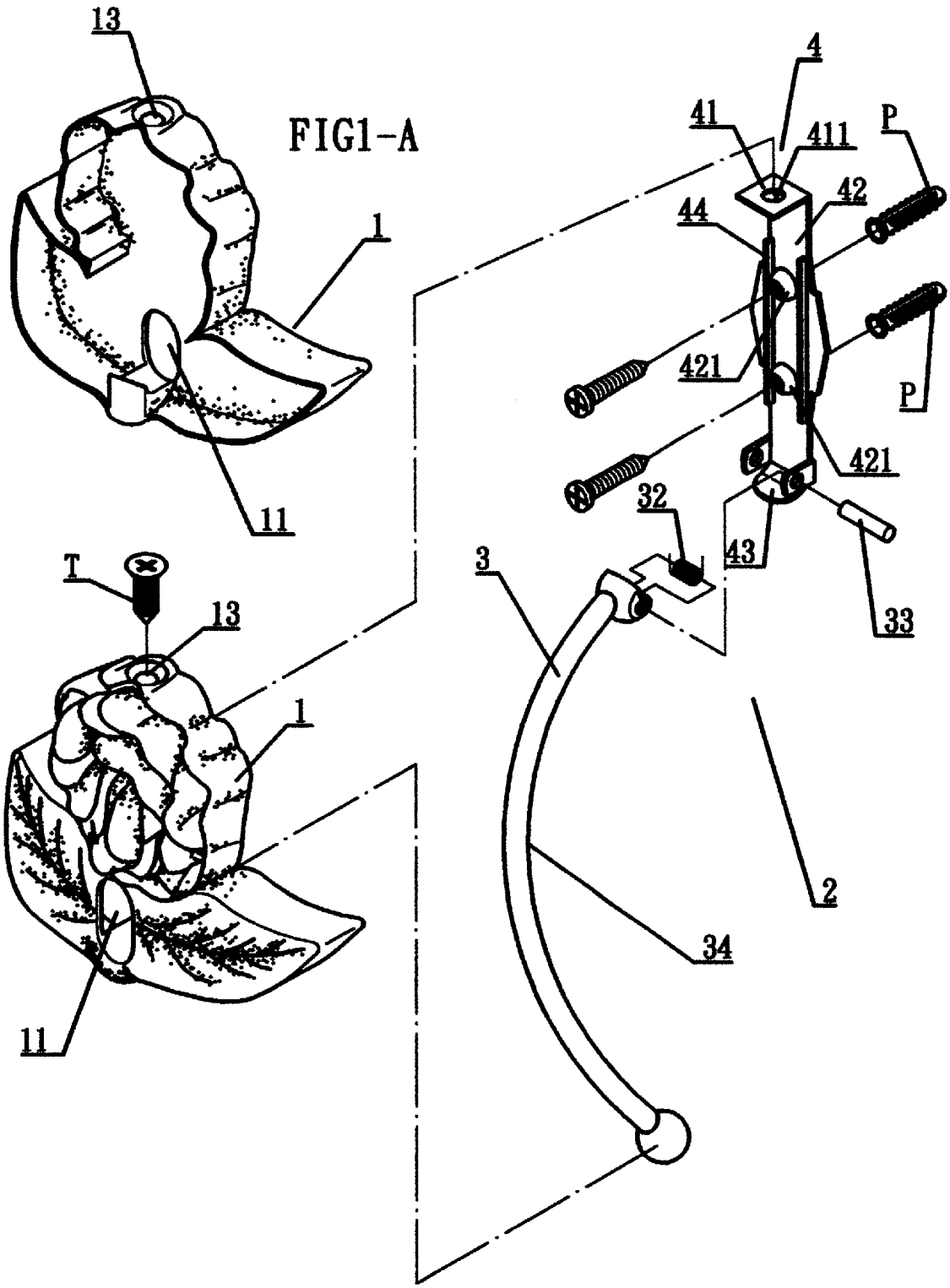
FIG. 1 is an exploded drawing of the invention herein.

Referring to FIG. 1, the structural configuration of the invention herein is comprised of a clip mount 2 positioned at the bottom end of a three-dimensional flower body 1 that provides for the holding of a window curtain A after it has been laterally draped, furthermore, a draw bar 3 is inserted into the bottom end of the body 1, of which:

The body 1 of the clip mount 2 is hollow on one side and, furthermore, is a shell structure having a fastener hole 13 formed in the top side wall, with the body 1 also having a straight surface of a certain thickness along its bottom section, a slightly curved front end and, furthermore, a recess 11 is formed in the bottom end of the body 1; the draw bar 3 is inserted into the recess 11 of the body 1 and, furthermore, after the draw bar 3 has been inserted, a joint section 12 is formed between it and the bottom wall surface of the body 1; disposed in the hinge section at the top end of the said draw bar 3 is a hole 31 and, furthermore, the hole 31 provides for the internal positioning of a torsion spring 32 and relative to the two sides of the torsion spring 3 of the draw bar 3, an insertion pin 33 is respectively inserted through the draw bar 3 and the torsion spring 32, thereby hinging it to a top support member 4.

One end of the said top support member 4 ascends vertically and, furthermore, respectively formed in its vertical surface 42 and horizontal surface 41 are threaded fastening holes; the threaded fastening holes 411 of the vertical surface 41 accommodates the installation of a bolt T that is tightened into the fastener holes 13 in the top end of the body 1 and other end of the top support member 4 is in the shape of a curved hook and, furthermore, the hooked section 43 is insertionally positioned in the joint section 12 formed between the bottom end of the body 1 and the draw bar 3 which provides for the mounting of the draw bar 3 at the bottom end of the body 1; disposed along the inner sides of the top support member 4 are two reinforcing ribs 44 that bolster the structure of the body 1 and, furthermore, the threaded fastening holes 421 in the vertical surface 42 of the top support member 4 consists of a protruding form such that when installed, the protruding area not only substitutes as a washer, but also eliminates the necessity of fitting a sleeve plug into wall surfaces, with the wall fastener P projecting slightly from the wall surface providing for the attachment of the top support member 4 to the surface of the wall.

Figure 2:
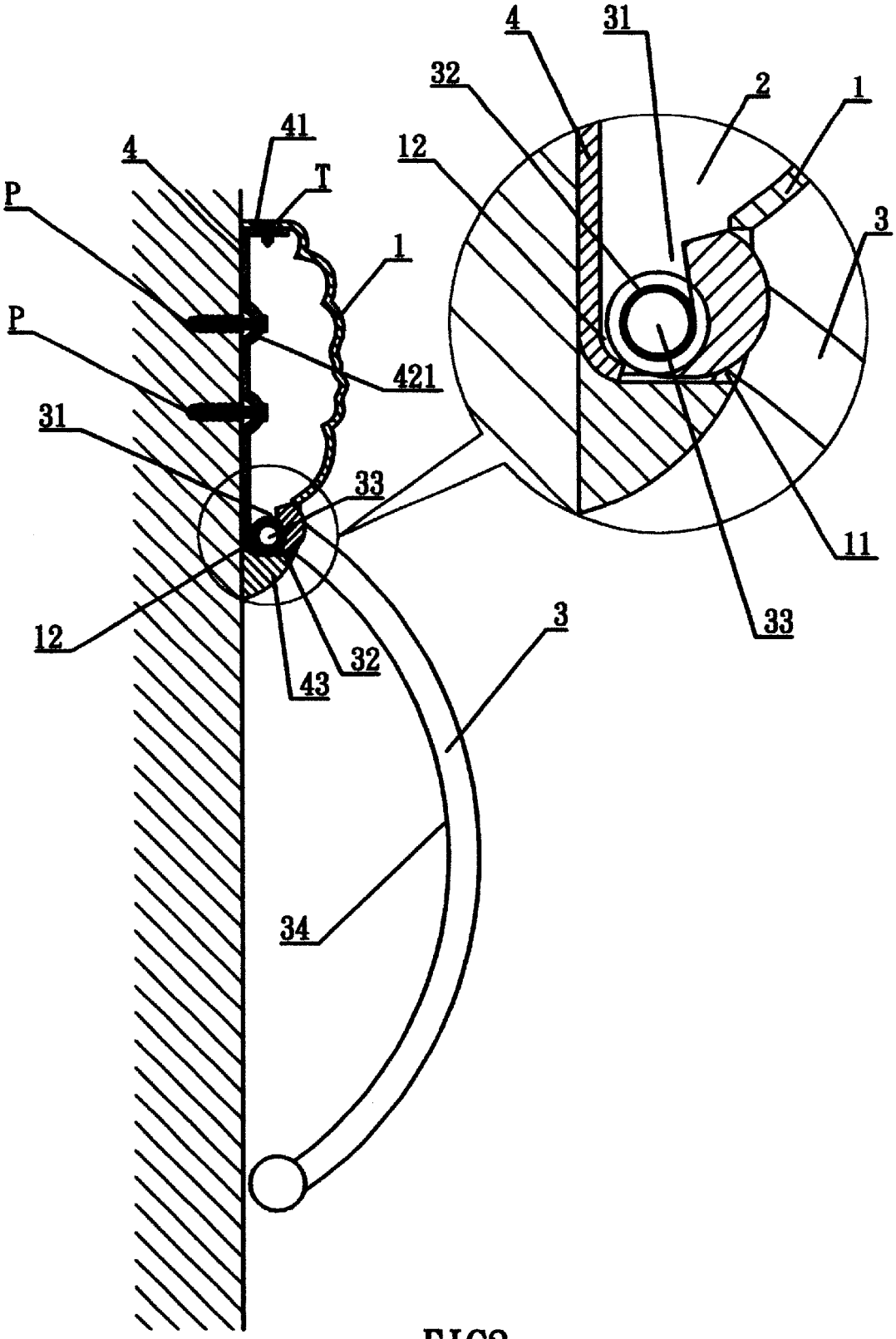
FIG. 2 is a cross-sectional drawing of the draw bar in the fixed position mode.
Figure 3:
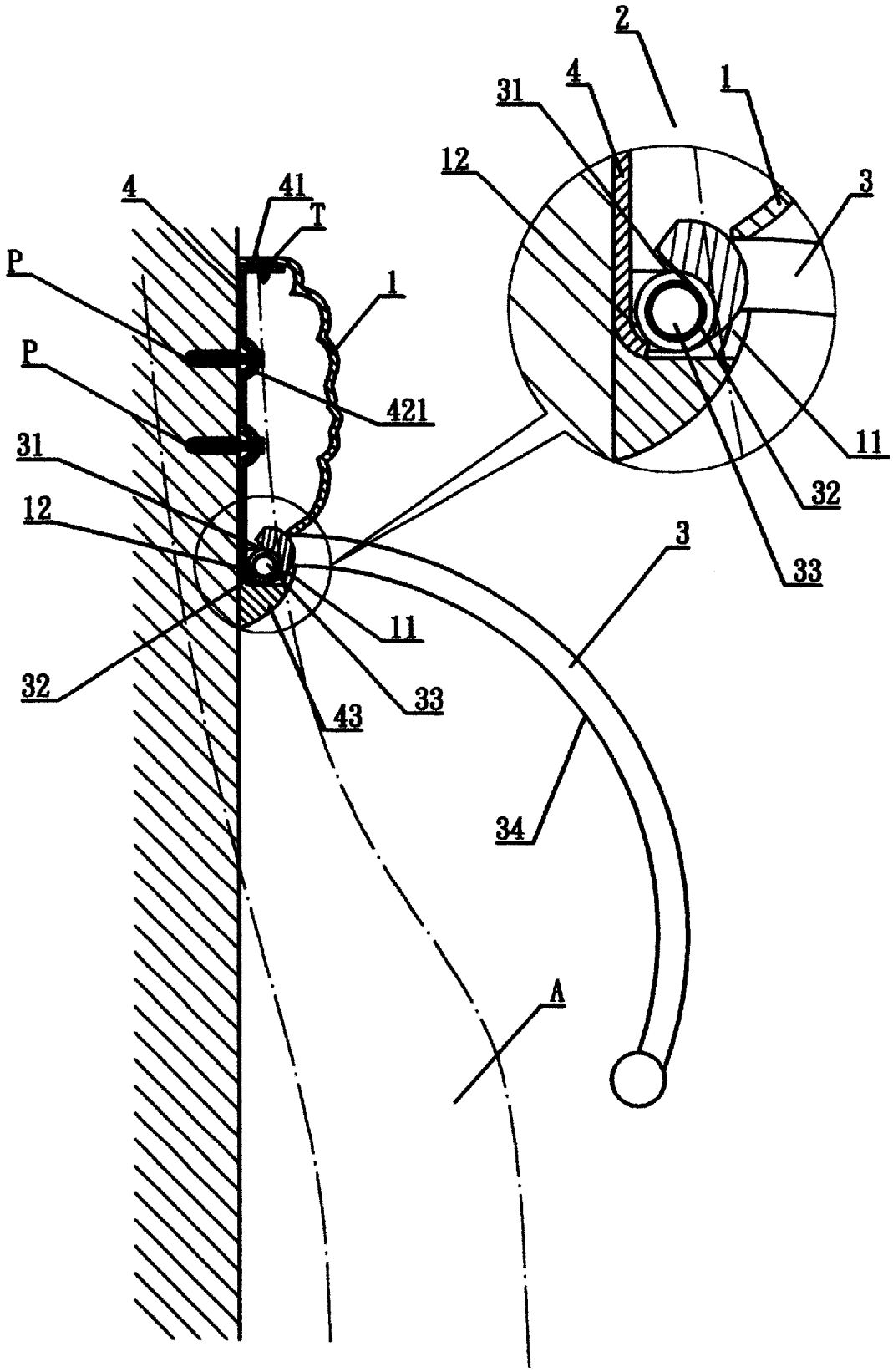
FIG. 3 is a cross-sectional drawing of the draw bar in the sunshade position mode.
Figure 4:
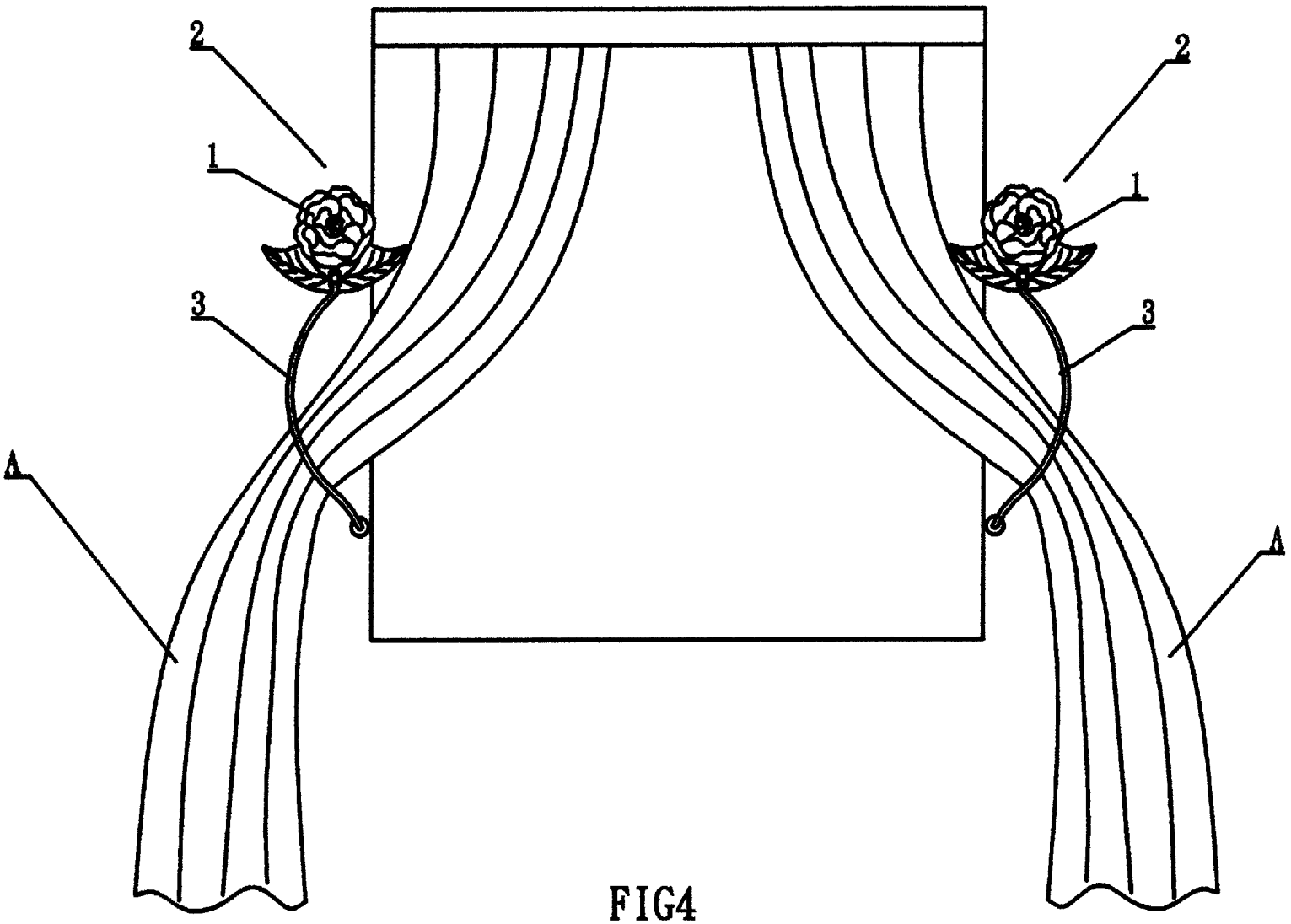
FIG. 4 is an orthographic drawing of the invention herein.

Referring to FIG. 2, FIG. 3, and FIG. 4 which depict the operating modes of the invention herein, when the window curtain is positioned apart, it is only necessary to lift open the draw bar 3 slightly upward, at which time the draw bar 3 is pulled into rotation against the torsion spring 32 such that bottom end of the draw bar 3 is separated a certain distance away from the wall surface and thereby provides for the draping of the window curtain A around the greater arcuate section 34 of the draw bar 3 and, when the draw bar 3 is released, the reversion force of the torsion spring 32 is exerted onto the wall surface and holds the two sides of the window curtain A in position (as shown in FIG. 2 and FIG. 4); when the user desires to close the window curtain A to prevent the entry of sunlight, it is only necessary to pull the draw bar 3 slightly upward, whereupon the window curtain A automatically slips out of the greater arcuate section 34 of the draw bar 3 and effectively assumes the sunshade mode (as shown in FIG. 3).

Figure 5:
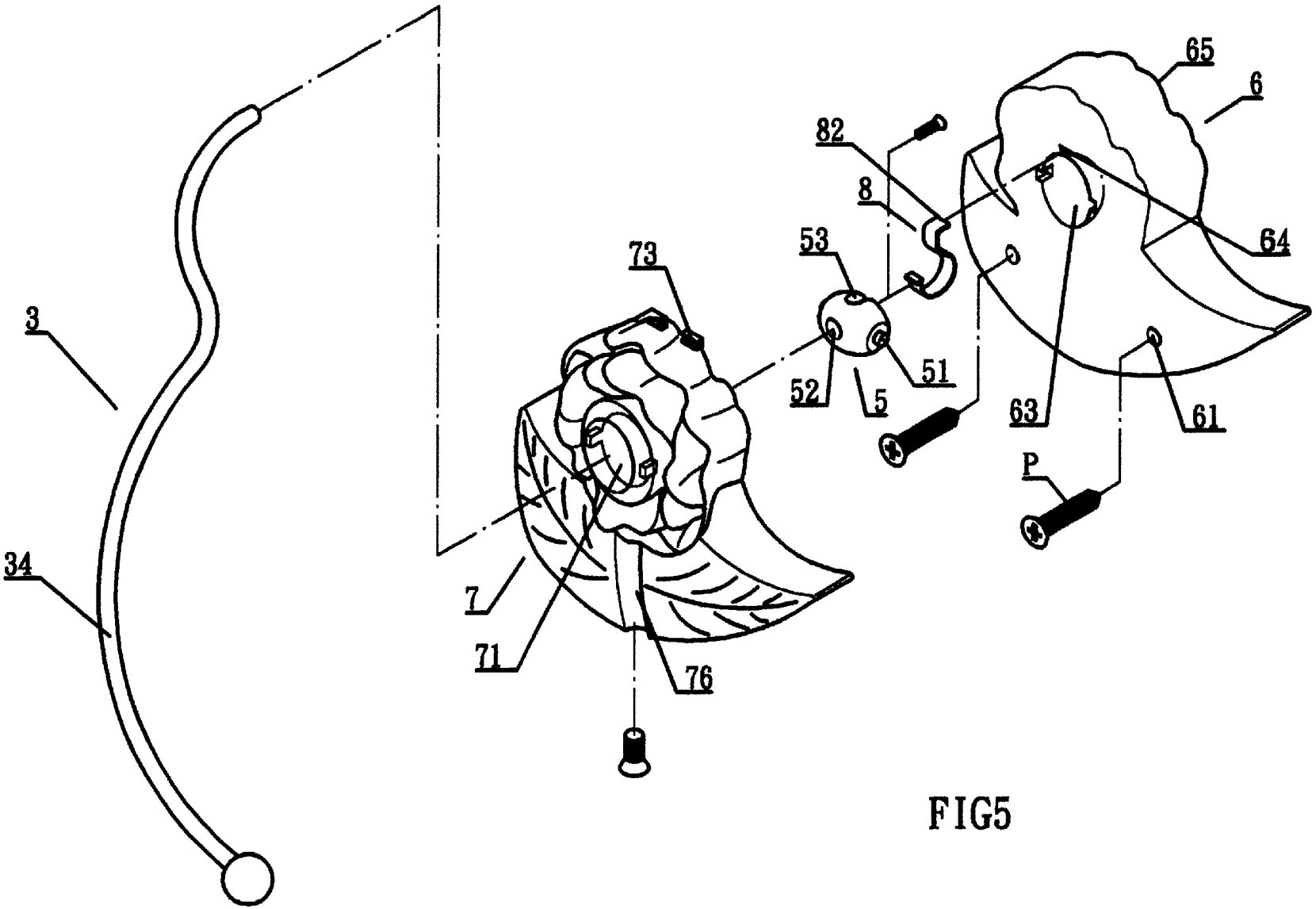
FIG. 5 is an exploded drawing of another embodiment of the invention herein.
Figure 6:
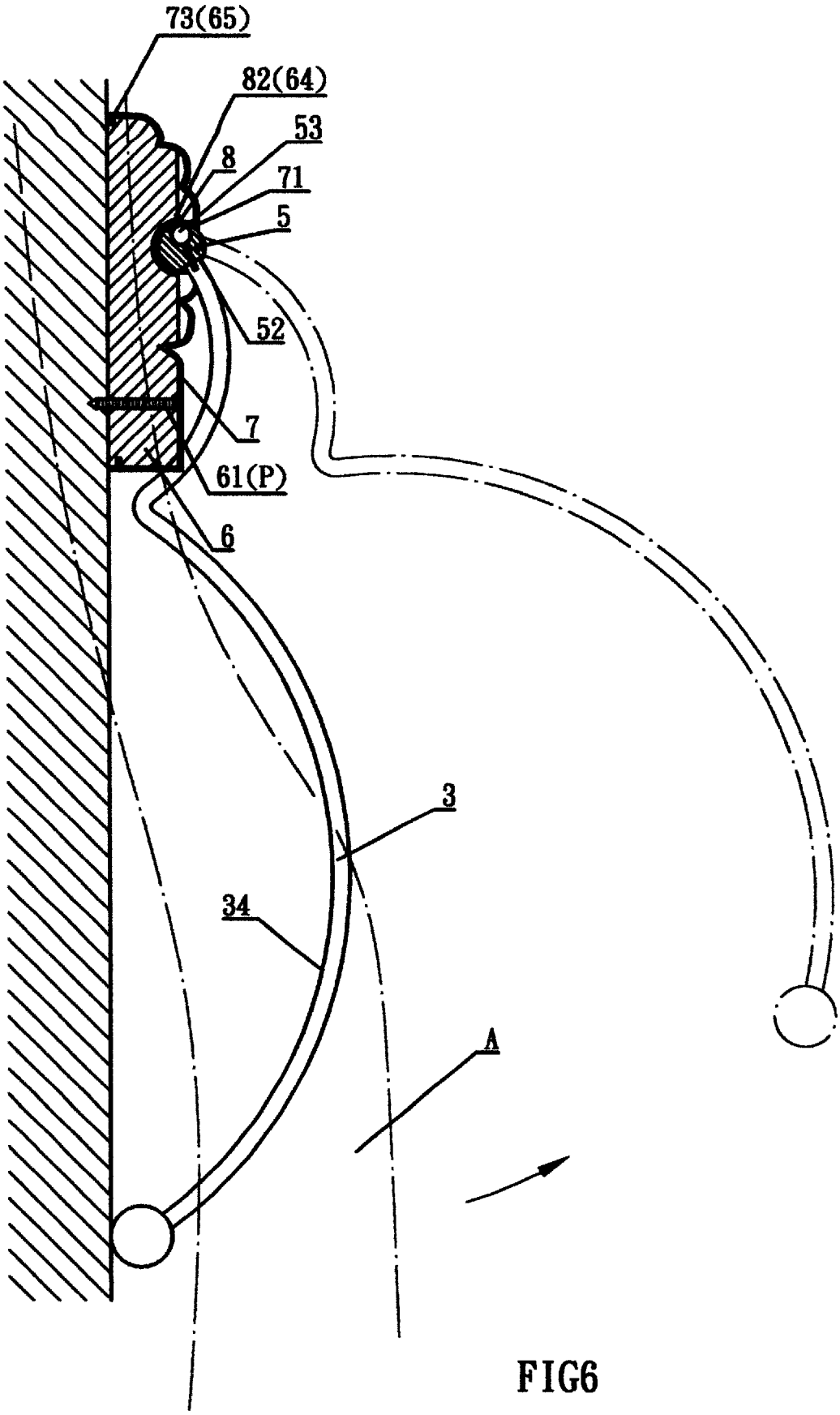
FIG. 6 is a cross-sectional drawing of the other embodiment of the invention herein.

Referring to FIG. 5 and FIG. 6, the other embodiment of the invention herein is comprised of a draw bar 3 having a greater arcuate section 34, a roller ball 5, a mounting block 6, a decorative plate 7, and a leaf spring 8 having a insertable foot 82, of which:

The said roller ball 5 has a mandrel 51 projecting from each of it two ends, with a small circular depression 52 formed in the front of the roller ball 5 and a concave notch 53 formed to the rear.

The said mounting block 6 has two through-holes 61 formed in its flat area for installation to the sides of a window frame, a socket 63 is formed in its upper extent such that after the roller ball 5 is placed therein, the mandrels 51 are secured into the two sides of the socket 63 and, furthermore, an anchor hole 64 is formed in the upper extent of the socket 63 and a plurality of small notches 65 are disposed for wall attachment.

The said decorative plate 7 has an access hole 71 formed though the center of its pistil that provides for the ensconcing of a portion of the roller ball 5 and, furthermore, the insertion of its mandrels 51 into the two sides of the access hole 71, and formed along the upper edge of the decorative plate 7 are a number of hook tabs 73 that engage the small notches 65; formed in the lower edge of the decorative plate 7 is a clip slot 76 that is utilized to clasp the draw bar 3.

Referring to FIG. 6, the draw bar 3 is extended through the access hole 71 of the decorative plate 7 and inserted into the small circular depression 52 of the roller ball 5, which thus secures the end of the draw bar 3; then, the leaf spring 8 is inserted into the concave notch 53 of the roller ball 5, with the insertable foot 82 slipped into the anchor hole 64 of the mounting block 6; the wall fastener P is then inserted for installation to the sides of a window frame or wall surface such that the roller ball 5 is held in position between the mounting block 6 and the decorative plate 7 and, furthermore, the hook tabs 73 of the decorative plate 7 are engaged to the small notches 65 of the mounting block 6.

To maintain the window curtain A positioned apart, it is only necessary to the pull the draw bar 3 upwards and drape the window curtain A around the greater arcuate section 34 and then release the draw bar 3, which allows the automatic force reversion of the leaf spring 8 to lever the draw bar 3 against the wall surface to hold the window curtain A in position; to close the window curtain A to ward off the sun, it is only necessary to slightly pull the draw bar 3, thereby allowing the window curtain A to automatically slip off the greater arcuate section 34 to block incoming sunlight; as such, the invention herein is an improved window curtain tieback device that is simple to assemble and, furthermore, is attractive in appearance.

In summation of the foregoing section, since the window curtain tieback device of the invention herein is original and innovative in structure, capable of achieving its claimed objectives, and meets all new patent application requirements, the present invention is submitted for review and the granting of the commensurate patent rights.

What is claimed is:

1. A window curtain tieback device comprising:

a) a mounting support member defining a mounting plane and being configured to be attached to a surface adjacent to a window having a window curtain;

b) a decorative body removably attached to the mounting support member so as to enclose the mounting support member, the decorative body having a hole through a front face thereof;

c) an elongated, arcuate draw bar extending through the hole in the decorative body, the draw bar having a first end pivotally connected between the mounting support member and the decorative body said pivotal connection being located on one side of said mounting plane, and a second end; and, d) a spring device located between the mounting support member and the decorative body, the spring device acting on the draw bar so as to bias the second end of the draw bar to the opposite side of said mounting plane and against a surface to which the mounting support member is to be attached.

2. The window curtain tieback device of claim 1 wherein the mounting support member includes:

a) a first surface having at least one first threaded fastening hole therein;

b) a second surface extending outwardly from the first surface and having a second threaded fastening hole; and c) a hinge pin pivotally attaching the first end of the draw bar to the first surface.

3. The window curtain tieback device of claim 2 wherein the spring device comprises a torsion spring acting between the mounting support member and the first end of the draw bar.

4. The window curtain tieback device of claim 2 further comprising a threaded fastener passing through the decorative body and engaging the second threaded fastening hole so as to removably attach the decorative body to the mounting support member.

* * * * *